US005819344A

United States Patent [19]

Otts

[11] Patent Number: 5,819,344

[45] Date of Patent: Oct. 13, 1998

[54] ADJUSTABLE AIRWAY MANAGEMENT APPARATUS FOR INFANTS

[76] Inventor: Shirley J. Otts, 413 12th St., Silvis, Ill. 61282

[21] Appl. No.: 679,476

[22] Filed: Jul. 12, 1996

[51] Int. Cl.[6] ..... A47B 7/02

[52] U.S. Cl. ..... 5/603; 5/607; 5/617; 5/634; 5/922

[58] Field of Search ..... 5/603, 922, 634, 5/607, 617, 601

[56] References Cited

U.S. PATENT DOCUMENTS

| | | | |
|---|---|---|---|
| D. 222,760 | 12/1971 | Meyer . | |
| D. 238,106 | 12/1975 | Arblaster . | |
| 1,103,730 | 7/1914 | Anderson | 5/634 |
| 2,389,269 | 11/1945 | Mermis . | |
| 2,671,442 | 3/1954 | Cameto . | |
| 3,804,082 | 4/1974 | Tarjan et al. . | |
| 3,870,038 | 3/1975 | Arblaster . | |
| 3,897,777 | 8/1975 | Morrison | 5/327 |
| 4,067,565 | 1/1978 | Daniels . | |
| 4,528,981 | 7/1985 | Behar | 5/922 |
| 4,566,449 | 1/1986 | Smith . | |
| 4,734,945 | 4/1988 | Wright . | |
| 5,048,136 | 9/1991 | Popitz . | |
| 5,193,238 | 3/1993 | Clute | 5/490 |
| 5,310,245 | 5/1994 | Lyszczasz | 5/922 |
| 5,499,418 | 3/1996 | Tan et al. | 5/922 |

FOREIGN PATENT DOCUMENTS

| | | | |
|---|---|---|---|
| 464150 | 4/1937 | United Kingdom | 5/634 |

*Primary Examiner*—Steven N. Meyers
*Assistant Examiner*—Fredrick Conley
*Attorney, Agent, or Firm*—Henderson & Sturm

[57] ABSTRACT

An apparatus for the relative positioning of the upper body, neck, and head of infants and young children for airway management and resuscitation. The apparatus is comprised of a support platform with a plurality of cylinders of various diameters which are secured beneath the platform and may be positioned so as to adjust the platform to the proper angle and elevation for the youth laid thereon. A pair of strips of hook and loop fastener are affixed to the lower surface of the platform which cooperate with a pair of bands of hook and loop fastener affixed around the cylinders. A mat is movably secured to the upper surface of the support platform and may secure an x-ray plate to permit the use of a portable x-ray machine for viewing possible lung collapse and the proper insertion of endotracheal tubes.

3 Claims, 2 Drawing Sheets

ADJUSTABLE AIRWAY MANAGEMENT APPARATUS FOR INFANTS

TECHNICAL FIELD

This invention relates to resuscitation aids, and more particularly to devices for the positioning of the upper body, neck, and heads of infants and young children to aid in airway management and resuscitation.

BACKGROUND ART

Resuscitation of infants and young children who have stopped breathing requires management of the infant's airway, resulting in proper alignment of the oropharyngeal, laryngeal and tracheal axes of the head and neck such that a straight, unobstructed airway passage is formed between the mouth and the larynx. This is particularly difficult for infants because of their relatively larger tongues, high glottis, narrow cricoid ring, large occiput and often elongated heads.

Airway alignment is achieved in adults by elevating the head about 10 cm with a pad or towel placed beneath the occiput with the shoulders remaining on the supporting surface and then flexing the neck and tilting the head backward. Various methods of airway alignment for infants include placing a rolled washrag or towel under the infants neck to cause the head to tilt backward, or simply have a nurse hold the infant such that the head tilts backward. U.S. Pat. No. 5,048,136 discloses the a cushion having head and torso cutout areas with a neck support therebetween. U.S. Pat. No. 3,870,038 discloses a resuscitation plaque with deep recess to receive and support the patients head in a backwardly and downwardly inclined position to aid in resuscitation. Neither of these devices, however, are adjustable in angle or elevation to allow for proper airway alignment of infants of different physical attributes.

DISCLOSURE OF THE INVENTION

The present invention discloses an apparatus for the relative positioning of the upper body, neck, and head of infants and young children for airway management and resuscitation. The apparatus is comprised of a support platform with a plurality of cylinders of various diameters which are secured beneath the platform and may be positioned so as to adjust the platform to the proper angle and elevation for the youth laid thereon. A pair of strips of hook and loop fastener are affixed to the lower surface of the platform which cooperate with a pair of bands of hook and loop fastener affixed around the cylinders. A mat is movably secured to the upper surface of the support platform and may secure an x-ray plate to permit the use of a portable x-ray machine for viewing possible lung collapse and the proper insertion of endotracheal tubes.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
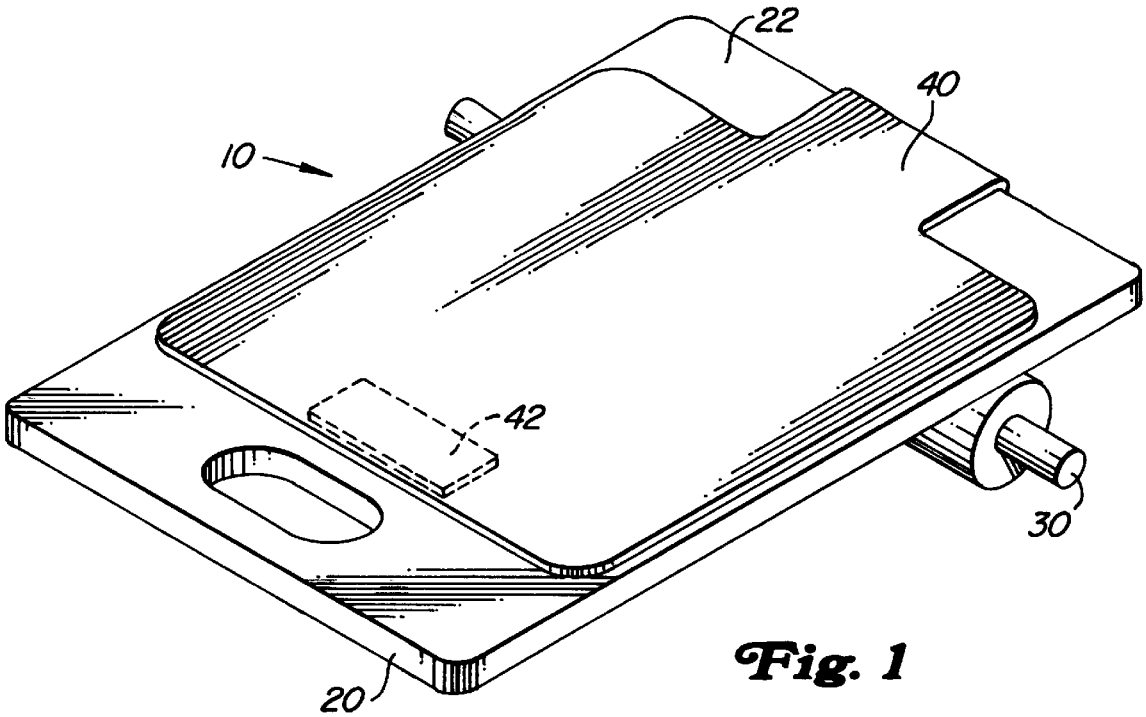
FIG. 1 is a perspective view of the invention from above.
Figure 2:
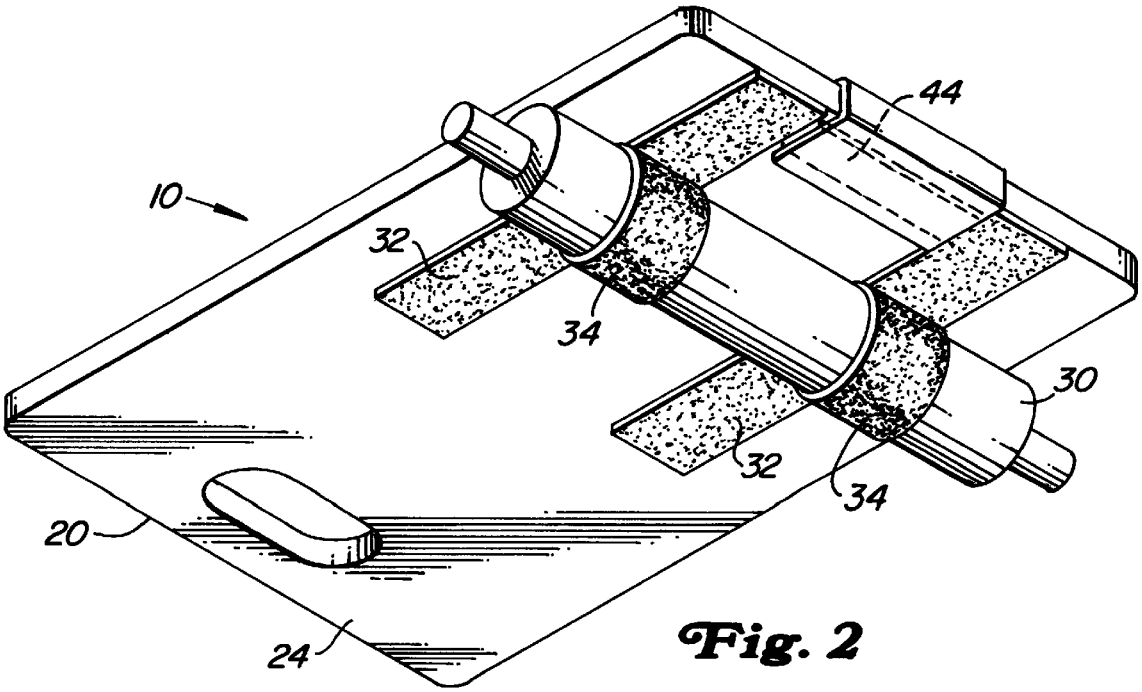
FIG. 2 is a perspective view of the invention from below.

Referring now to the drawings, wherein like reference numerals designate identical or corresponding parts throughout the several views, the invention 10 is shown in perspective views in FIGS. 1 and 2, and is seen to comprise a support board 20, an adjustment cylinder 30, and a mat 40.

Figure 5:
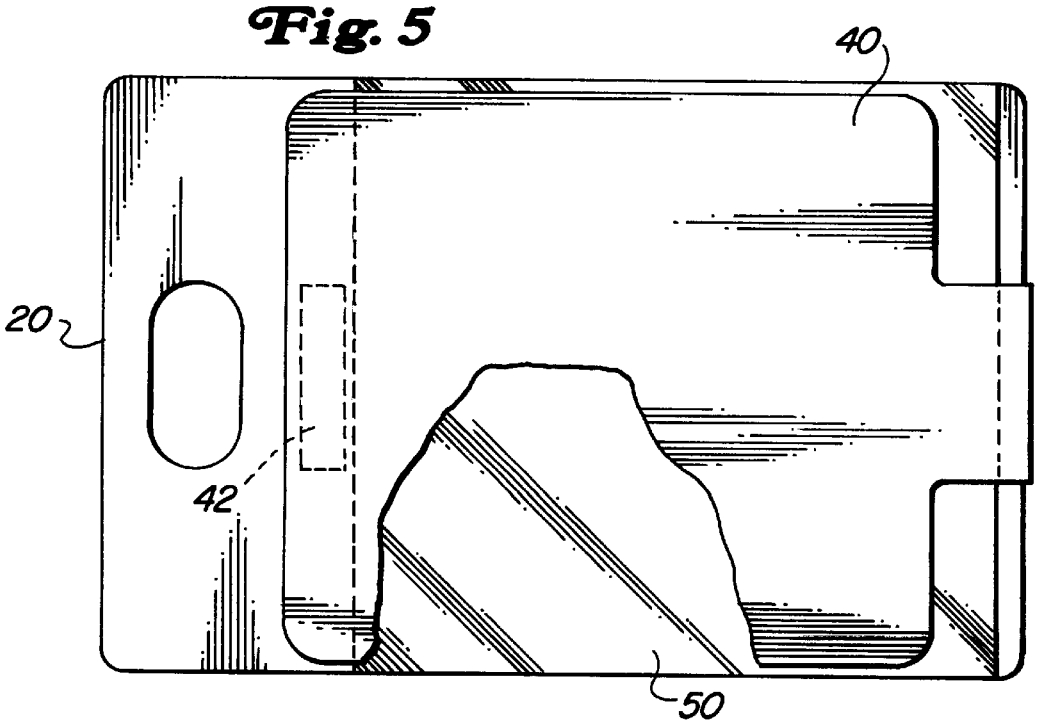
FIG. 5 is a top plan view of the invention with a part of the mat cut away to reveal an x-ray plate held thereunder.

The mat 40 is removably affixed to the upper surface 22 of the support board 20 by a strip of hook and loop fastener 42. The mat then extends around the elevated end of the board 20 where it is removably affixed to the lower surface 24 of the support board 20 by a second strip of hook and loop fastener 44. As seen in partial cutaway in FIG. 5, the removable nature of the mat 40 permits an x-ray plate 50 to be inserted and held thereunder should x-rays be necessary as for example to examine for collapsed lungs or to examine for proper insertion of endotracheal tubes.

Figure 3:
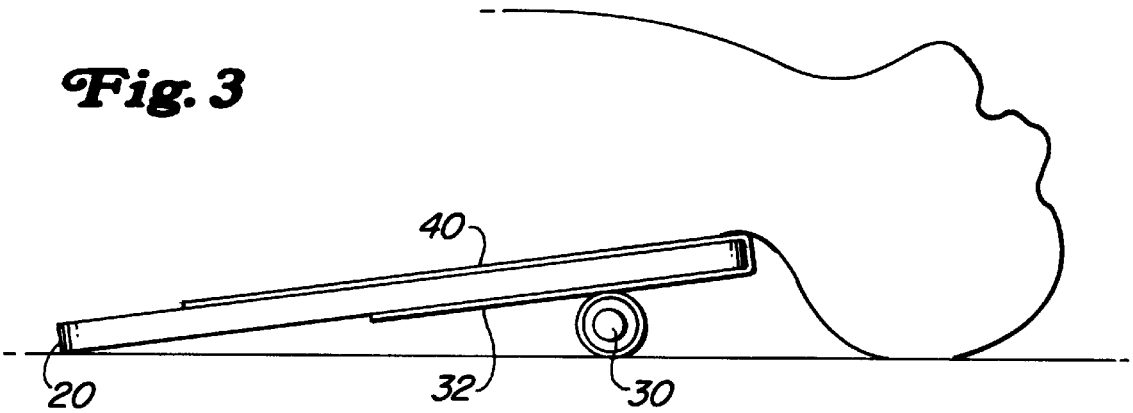
FIG. 3 is a side elevation of the invention supporting an infant and utilizing a larger adjustment cylinder.
Figure 4:
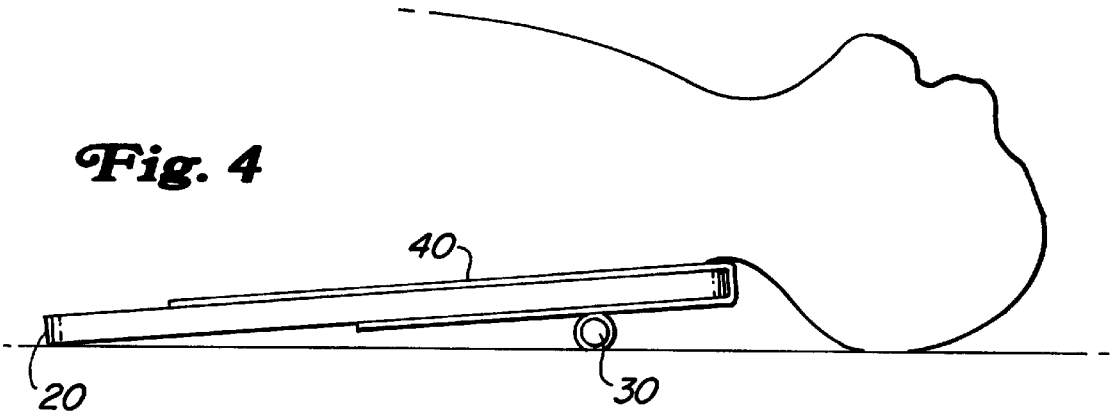
FIG. 4 is a side elevation of the invention supporting an infant and utilizing a smaller adjustment cylinder.

The adjustment cylinders 30 are, as seen in FIGS. 3 and 4, available in a plurality of diameters to permit adjustment in the angle of the support board 20 and the height of the elevated end of the support board 20. The angle and elevation may be further adjusted by the location of placement of the adjustment cylinder 30 beneath the support board 20. When a proper angle and elevation has been established for proper airway management, the adjustment cylinder 30 is held in place by means of a pair of strips of hook and loop fastener 32 secured to the lower surface 24 of the support board which cooperate with a pair of bands of hook and loop fastener 34 affixed around the adjustment cylinders.

It is envisioned that this adjustable airway management apparatus would be used as follows. An infant or small child in need of airway management and/or resuscitation would be laid on his/her back on the support board 20 with the head extending past the end of the board as seen in FIGS. 3 and 4. Different sized cylinders 30 may be inserted beneath the board, and these cylinders 30 may be positioned beneath the board to accomplish the proper angle and elevation to achieve an open airway for the victim. Resuscitation would then begin. If resuscitation fails, a laryngoscope could be inserted to locate the trachea for insertion of an endotracheal tube. If respirations and heart rate still do not increase, then cardiopulmonary resuscitation would begin.

Those skilled in the art will recognize that numerous modifications and variations of the present invention are possible in light of the above teachings. With an adjustment in size, this invention can be easily adjusted for adult cardiopulmonary resuscitation. The apparatus would result in a practical and portable resuscitation board which could be used by, but not limited to, medical personnel including ambulance and other emergency medical teams. It is therefore to be understood that, within the scope of the appended claims, the invention may be practiced otherwise than as specifically described.

What is claimed is:

1. An adjustable airway management and resuscitation apparatus for infants and young children, comprising:

a support platform having a longitudinal axis, an upper surface, a lower surface, a first end and a second end;

at least one strip of hook and loop fastener fixedly secured to said lower surface and aligned generally parallel to the longitudinal axis of said support platform; and a first angle and elevation adjustment cylinder provided with at least one peripheral strip of hook and loop fastener for movably affixing said angle and elevation adjustment cylinder relative to the lower surface of said support platform.

2. The apparatus as recited in claim 1 and further comprising at least a second adjustment cylinder having a different diameter than said first cylinder.

3. The apparatus as recited in claim 1 and further comprising a mat covering at least a portion of said upper surface of said support platform and extending around said first end to said lower surface, said mat being removably secured to said platform whereby an x-ray film may be held thereunder.

* * * * *